US007017463B1

(12) United States Patent
Simpson

(10) Patent No.: US 7,017,463 B1
(45) Date of Patent: Mar. 28, 2006

(54) TRIM EDGE STRIPPER FOR A CORRUGATED BOARD ROTARY CUTTING DIE

(75) Inventor: Jack R. Simpson, Raleigh, NC (US)

(73) Assignee: Container Graphics, Co., Cary, NC (US)

( * ) Notice: Subject to any disclaimer, the term of this patent is extended or adjusted under 35 U.S.C. 154(b) by 0 days.

(21) Appl. No.: 10/100,304

(22) Filed: Mar. 18, 2002

Related U.S. Application Data

(63) Continuation-in-part of application No. 09/054,564, filed on Apr. 3, 1998, now abandoned.

(51) Int. Cl.
*B26D 7/18* (2006.01)

(52) U.S. Cl. ..... 83/117; 83/128; 83/139; 493/82; 493/472

(58) Field of Classification Search ..... 493/472, 493/60, 64, 365, 370, 71, 56, 82; 83/115, 83/116, 117, 322, 323, 348, 310, 314, 128, 83/139; 222/407, 225; 267/153, 159, 130, 267/141, 141.1
See application file for complete search history.

(56) References Cited

U.S. PATENT DOCUMENTS 3,198,093 A * 8/1965 Kirby et al. ..... 493/472 X
3,231,261 A * 1/1966 Huffman ..... 83/323 X
3,355,969 A * 12/1967 Sarka ..... 493/60 X
3,552,244 A * 1/1971 Smith, Jr. ..... 83/116
3,946,627 A * 3/1976 Hofmann ..... 83/117
4,349,140 A * 9/1982 Passafiume ..... 83/117 X
4,896,573 A * 1/1990 Kapolnek ..... 83/117
5,111,725 A * 5/1992 Simpson et al. ..... 83/117
5,161,442 A * 11/1992 Rilitz et al. ..... 83/117
5,636,559 A * 6/1997 Smithwick, Jr. et al. ..... 83/116
5,701,789 A * 12/1997 Okonski ..... 83/117 X
5,881,620 A * 3/1999 Smithwick, Jr. et al. ..... 83/116
6,071,225 A * 6/2000 Kucharski ..... 493/472 X

* cited by examiner

*Primary Examiner*—Charles Goodman
(74) *Attorney, Agent, or Firm*—Coats & Bennett, P.L.L.C.

(57) ABSTRACT

A rotary cutting die apparatus for cutting corrugated board and trimming an outside trim piece from the corrugated board. The rotary cutting die apparatus includes a die cylinder, a cutting die mounted to the die cylinder, and an anvil cylinder disposed adjacent the die cylinder. Mounted on the cutting die is at least one trim cutting blade for trimming an outside portion from a corrugated board passing between the die cylinder and the rotary anvil. Mounted on the cutting die outside of the trim blade is one or more trim strippers or devices for engaging the cut trim pieces and moving the cut trim pieces away from the cutting die and generally separating them from the finished corrugated board product produced by the die cutting apparatus. In the case of the embodiment illustrated herein, each trim stripper or device includes a base secured to the cutting die and an angled elastomer finger extending from the base. During operation, the finger is deflected to a trim engaging position where the finger engages a piece of cut trim. As the finger moves from a nip area defined between the die cylinder and the rotary anvil, the elastomer finger springs back to a normal position and in the process moves or throw the cut trim piece downwardly and away from the cutting die.

31 Claims, 18 Drawing Sheets

TRIM EDGE STRIPPER FOR A CORRUGATED BOARD ROTARY CUTTING DIE

CROSS REFERENCE TO RELATED APPLICATION

The present application is a continuation-in-part of U.S. patent application Ser. No. 09/054,564 filed Apr. 3, 1998, now abandoned.

SUMMARY OF THE INVENTION

The present invention relates to a trim stripper or device for engaging outside trim cut from a corrugated board by a cutting die and moving the cut trim away from the cutting die. The trim stripper or device of the present invention comprises an elastomer member having a base and a finger. The base is adapted to be secured to the cutting die such that in a normal position the finger extends outwardly from the cutting die. The finger is adapted to be deflected to a trim engaging position. When the finger is deflected to the trim engaging position, the finger engages a cut piece of outside trim that has been cut by the cutting die. After the cut trim has been engaged, the deflected finger springs back or moves back to its normal position. In the process, the cut trim engaged by the finger is moved away from the cutting die.

In one particular embodiment of the present invention, the trim stripper or device is mounted on a rotary cutting die that is disposed adjacent an anvil cylinder. A nip is defined between the rotary cutting die and the anvil cylinder. As the rotary cutting die and anvil cylinder rotate, the trim stripper or device passes through the nip and as the trim stripper or device passes through the nip, the finger is deflected to the trim engaging position. In the trim engaging position, the finger engages an outside trim piece that is cut from a corrugated board by the rotary cutting die. The finger in the deflected position, because of the elastomer nature of its construction, includes stored energy. Once the finger passes through the nip then it is free to spring back or move back to its normal position. As the finger moves back or springs back to its normal position, the finger will flip or move the engaged cut trim piece away from the rotary cutting die. Further, the movement of the cut trim away from the cutting die effectively separates the cut trim from the corrugated board product produced by the rotary cutting die.

Figure 1:
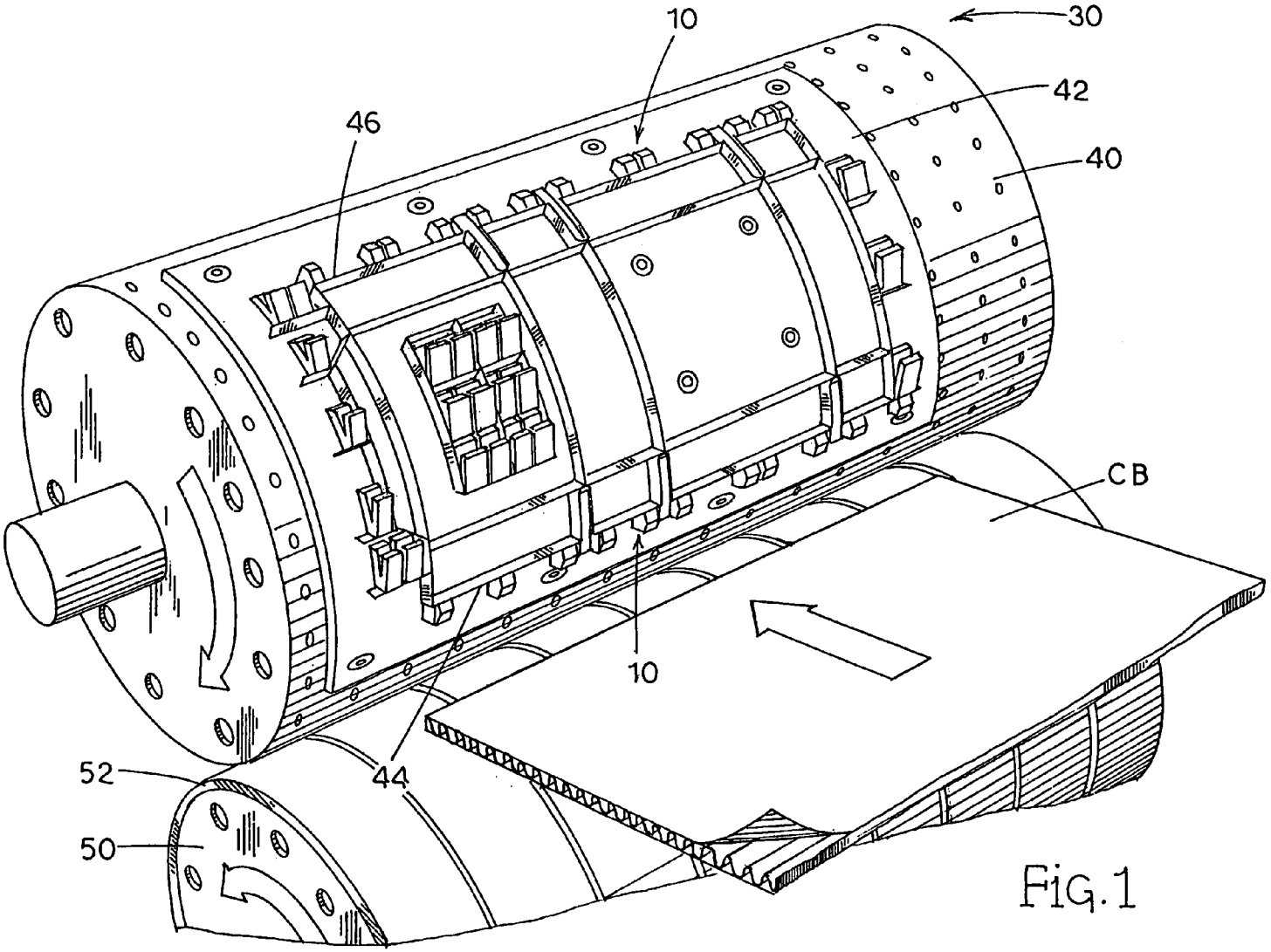
FIG. 1 is a perspective view of a typical corrugated board rotary die cutting apparatus.

Shown in FIG. 1 is a corrugated board rotary die cutting apparatus, generally indicated by the numeral 30. Die cutting apparatus 30 is comprised of a pair of rotatably mounted, cooperating cylinders or drums. More particularly, the die cutting apparatus 30 includes a cutting cylinder 40 and an anvil cylinder 50. Mounted on the cutting cylinder 40 is a generally cylindrical die board 42, which is typically made of laminated plywood. Die boards, such as that illustrated in FIG. 1, typically include a combination of cutting blades, creasing rules, resilient scrap strippers, resilient product ejectors, and the like. As such and with particular regard to the invention disclosed herein, die board 42 includes a series oaf leading edge trim cutting blades 44, which are securely mounted therein such that the cutting tips of the blades 44 protrude and extends generally outwardly away from the surface of the cylinder 40. Each trim cutting blade 44 includes a pair of opposed sides or edges 44*a* and 44*b*. For purposes of reference, edge 44*a* is referred to as a scrap edge while the other side 44*b* is referred to as a product edge. It should be pointed out that the scrap edge 44*a* and product edge 44*b* are defined relative to the edge of a blank of corrugated board CB that is to be trimmed. That is, as the cutting blade 44 moves into position and begins to penetrate the incoming blank of corrugated board CB, the blade effectively divides the blank into a trim or scrap region and a product region. The scrap edge 44*a* of the cutting blade 44 is defined herein as the edge or side of the cutting blade that is immediately adjacent the scrap region. As such, the scrap edge 44*a* of the cutting blade will also be immediately adjacent and face the scrap material 62 (FIGS. 4C–4F) that is severed from the blank during the cutting process. Conversely, the product edge 44*b* of the cutting blade 44 is defined herein as the edge or side of the cutting blade that is immediately adjacent the finished or product region of the blank CB.

Die board 42 also includes a series of trailing edge trim cutting blades 46, which are securely mounted therein such that the cutting tips of the blades 46 protrude and extend generally outwardly away from the surface of the cylinder 40. It will be appreciated that, as with the leading trim blades 44, the trailing trim blades 46 also include a scrap edge 46*a* and a product edge 46*b*, which are defined in a manner analogous to that of the leading blade edges.

As shown in FIG. 1, further disposed on the surface of the die board 42, immediately adjacent the leading and trailing trim blades 44 and 46, respectively, are a series of resilient trim strippers, generally indicated by the numeral 10. In the case of the leading trim blades 44, the trim strippers 10 are disposed so as to trail these blades. Consequently, these trim strippers 10 are said to be disposed forwardly of the trailing trim blades 46.

Figure 2A:
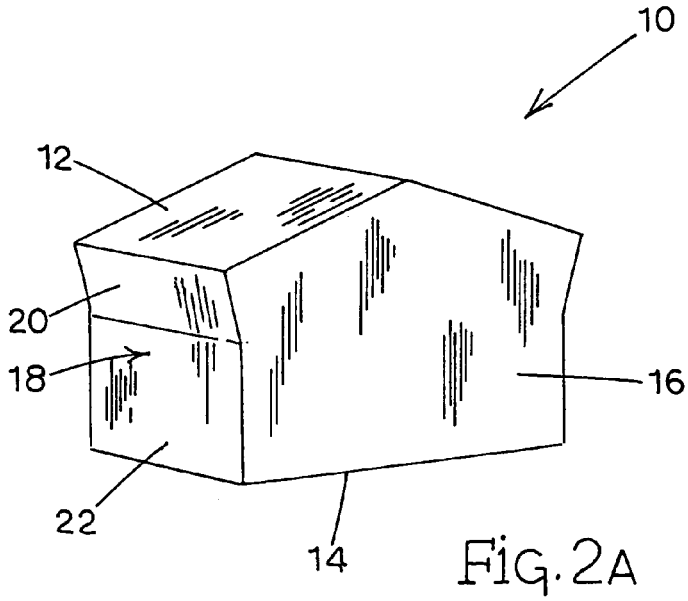
FIG. 2A is a perspective view of the trim stripper of the present invention.
Figure 2B:
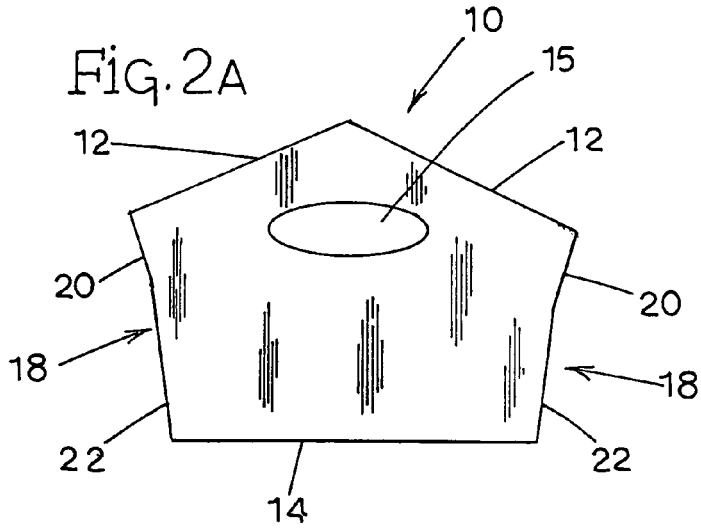
FIG. 2B is a side elevational view of an alternative design for the trim stripper.
Figure 3A:
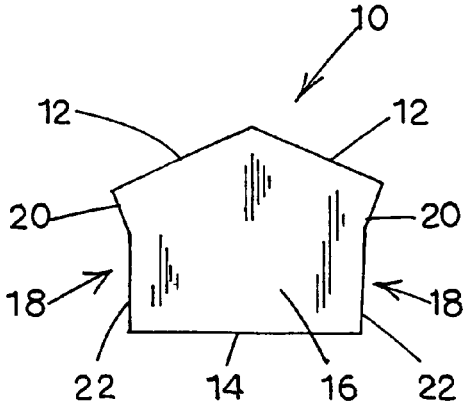
FIG. 3A is a side elevational view of the trim stripper of FIG. 2.
Figure 3B:
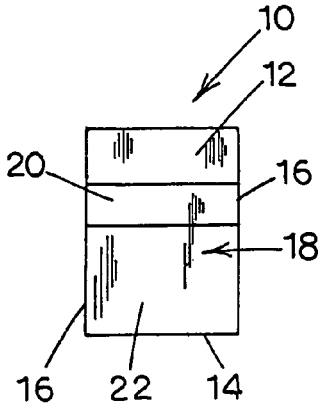
FIG. 3B is a left side elevational view of the trim stripper of FIG. 2 viewed from one end.
Figure 3C:
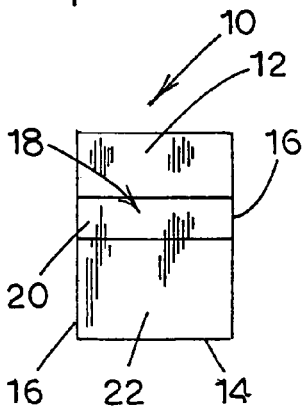
FIG. 3C is an elevational view of the trim stripper of FIG. 2 viewed from the other end.

Shown in FIG. 2 is a first embodiment of the resilient trim stripper 10, which includes a generally pentagonal shape, with the top of this pentagon being comprised of a pair of angled stripper surfaces 12. As illustrated in FIGS. 3A–3C, the pentagonal shaped stripper 10 further includes a generally horizontal base 14, and a pair of generally vertical, sides 16. A pair of front and rear edge surfaces, generally indicated by the numeral 18, form the two remaining sides of the pentagonal shaped stripper 10. While the edge surfaces 18 are generally vertical in nature, the exact shape of these surfaces, in the embodiment illustrated, is in fact not linear. For purposes of illustration, each edge surface 18 may be considered to be comprised of a separate upper curved or bevel filler region 20 and a lower linear or flat region 22, as shown in FIGS. 2 and 3A. As will be appreciated from subsequent discussions, the filler region 20 is designed to fit flush against the upper beveled area of a respective trim blade 44 or 46 so as to effectively fill the beveled formed along one upper side or edge of the blade.

FIG. 2A depicts a slightly different embodiment of the trim stripper 10 than that shown in FIG. 2. The embodiment of FIG. 2A is essentially the same as the embodiment of FIG. 2 except that an aperture 15 is formed in the body of the trim stripper 10. Although the aperture 15 may be placed or disposed in various portions of the trim stripper 10, in the case of the embodiment shown herein the aperture 15 extends transversely through the body of the trim stripper 10. Aperture 15 will generally make the trim stripper 10 more compressible for a given hardness. Thus by incorporating the aperture 15, in some cases it may be possible to extend the height of the trim stripper 10 for a given hardness.

Trim stripper 10 is typically manufactured from a resilient material such as a 70 to 100 durometer closed cell rubber, although foam or other materials exhibiting appropriate resilient characteristics may also be utilized.

As illustrated in FIG. 1, the anvil cylinder 50 is disposed adjacent the cutting cylinder 40 and is typically surrounded or sheathed with a surface layer or coating 52 of a relatively compliant material such as urethane, which provides a backing surface against which a cut can be made without damaging the cutting blades 44 and 46 or any other cutting blades or creasing rules disposed on the die board 42. As such, anvil cylinder 50 rotates in a manner that is generally synchronous with the adjacent cutting cylinder 40 during normal operation.

Returning now to a discussion of the cutting cylinder 40 configuration, the trim strippers 10 are typically positioned on the cutting die 42 immediately adjacent the cutting blades 44 and 46, as shown in FIG. 1. Each stripper 10 is further oriented such that the stripper base 14 is in contact with the die board 42, as shown in FIG. 4A. Securing of the trim stripper 10 to the die board 42 is generally accomplished through the use of chemical adhesives or glues which are applied to the stripper base 14, although other suitable securing techniques could be employed. Furthermore, the size of the base 14 is chosen so as to provide ample surface area for gluing, which ultimately leads to a more secure mounting and a generally longer stripper life span. The cutting blade configuration illustrated in FIGS. 4A–4F is for a leading edge type trimming operation, as opposed to side or trailing edge trimming. With the stripper base 14 contacting the die board 42, stripper 10 is further oriented such that one of the edge surfaces 18 abuts the scrap edge 44*a* of the trim cutting blade 44. Positioned as such, it will be appreciated that the contour of the stripper edge surface 18 allows the stripper 10 to mate tightly with the face of the adjacent cutting blade 44. That is, the upper curved or bevel filler region 20 of the stripper edge surface is contoured so as to generally conform to and mate with the beveled shape of the cutting blade tip, while the lower flat region 22 of the stripper edge surface fits flush against the lower portion of the cutting blade face.

As shown in FIG. 4A, when positioned adjacent the cutting blade 44 as described above, the angled stripper surface 12 disposed closest to the cutting blade is generally aligned flush with the blade tip in the embodiment shown. From the blade tip, the angled surface 12 extends generally outwardly and away from the scrap edge 44*a* of the blade. It should be appreciated that the other angled stripper surface 12 disposed furthest from the cutting blade is not actively involved in the functioning of the stripper. This second angled surface is included primarily as a matter of manufacturing and operational practicality. That is, the additional angles surface is in some respects a convenient side effect of the gluing area considerations related to the stripper base 14. As discussed previously, enlargement of the base 14 provides a larger gluing surface area for use in mounting the stripper 10 to the die board 42. Furthermore, the additional angled surface 12 is typically fabricated so as to have a different slope than the adjoining angled surface. This concept is illustrated in FIGS. 3B and 3C. Thus, the trim stripper 10 is reversal and the die operator can choose between two angled stripper surfaces depending upon the particular die configuration and the properties of the blank material to be trimmed.

As the operation and general construction of the rotary die cutters of the type contemplated herein is well known and widely understood, a detailed discussion of the operational theory of corrugated board die cutters will not be presented. It is considered sufficient for the purposes of this disclosure to describe the rotary die cutter 30 contemplated herein as comprising the die cutting cylinder 40 and anvil cylinder 50, as described above. In general, these cylinders are rotatably mounted adjacent one another such that a small gap or nip 80 (see FIG. 4A) exists between their opposing surfaces. A partial view of such a typical cylinder configuration is shown in FIGS. 4A–4F. During normal operation, the cylinders are rotated in opposite directions relative to one another, at approximately the same speed. As such, movement of the cylinder surfaces in the immediate vicinity of the nip 80 will be generally in the same direction, with both surfaces moving at approximately the same speed. Once again, this concept of counter-rotation and uniform surface movement through the nip 80 is illustrated in FIGS. 4A–4F.

Figure 4B:
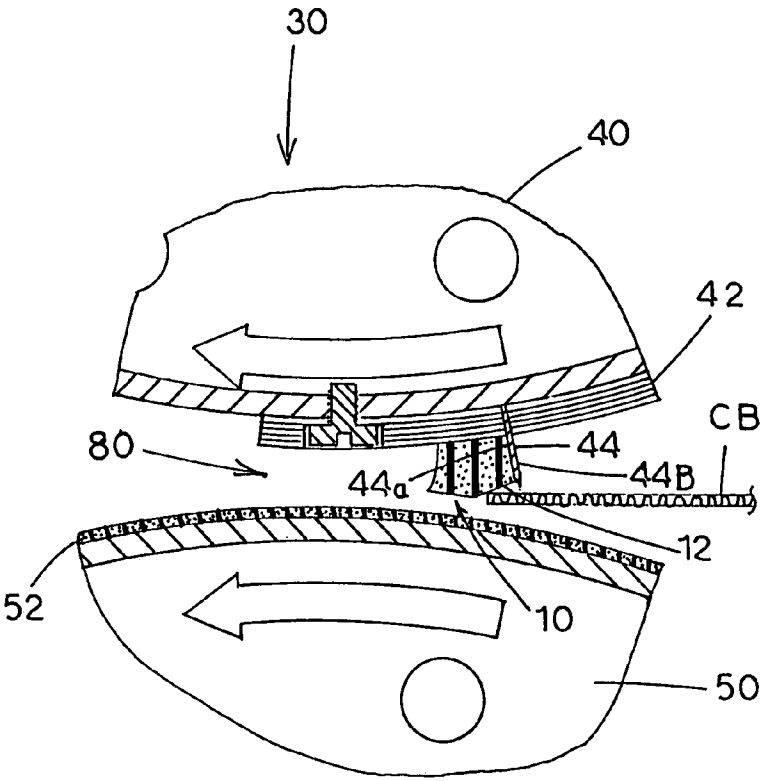
FIGS. 4A–4F are a sequence of fragmentary sectional views illustrating the movement of the trim stripper and a sheet of corrugated board through the nip defined between the cutting die and anvil or a rotary die cutting assembly.
Figure 4A:
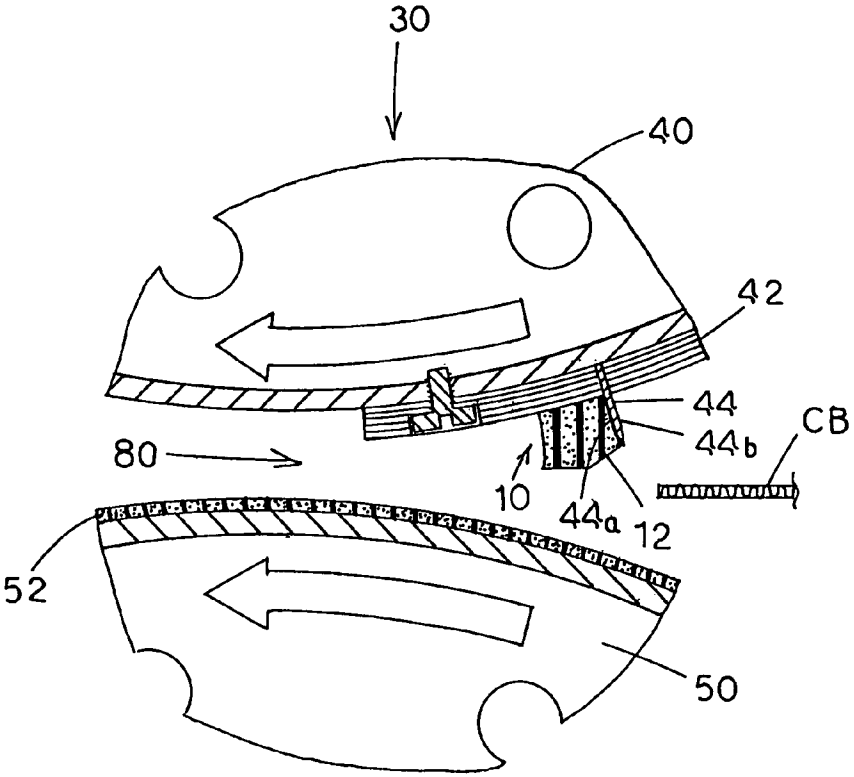

As previously stated, the trim stripper 10 illustrated in FIGS. 4A–4F is configured to act as a leading edge stripper and, as such, trimming and stripping of the corrugated board CB begins with the insertion or entry of the corrugated board blank CB into the die cutter 30. Insertion of the corrugated board CB into the die cutter is synchronized with the position of the trimming or cutting blade 44, such that the edge of the blank that is to be trimmed enters the nip 80 at approximately the same time as the cutting blade, as shown in FIG. 4A. The cutting blade 44 and incoming blank CB will tend to move together into and through the nip with the leading edge region of the blank that is to trimmed just leading the adjacent blade, as illustrated in FIG. 4B. It will be appreciated that as the blank CB approaches the nip 80, the blade 44 and interally mounted stripper 10 move closer to the adjacent blank as a consequence of the cylindrical nature of the cutting die 40. AS the angled surface 12 (that is the angle surface 12 adjacent the blade 44) of the stripper 10 extends beyond the tip of the cutting blade 44, the surface 12 makes first contact with the incoming blank CB. As described previously, there are two angled surfaces 12 which form the top of stripper 10, and under normal operating conditions it is the angled surface disposed adjacent and abutting the scrap edge 44*a* of the cutting blade 44 which is responsible for making first contact with the incoming bland, as illustrated in FIG. 4B. More particularly synchronization of the blank and cutting blade 44 generally insures that the first contact made by angled surface 12 is with the edge or scrap region of the blank CB that is to be trimmed.

At this point, it should become apparent that the angled nature of the surface 12 allows the stripper to smoothly contact and capture the leading edge of the blank, greatly reducing the potential for an initial destructive misalignment at the stripper-blank interface. As further illustrated in FIG. 4C, synchronized movement of the cutting blade 44 and blank CB towards the nip 80 brings the bland, trim cutting blade 44, and stripper 10 continually closer together. The stripper 10, being constructed of a resilient material, tends to be elastically deformed by the encroaching blank material. The forces generated within the elastically deformed stripper 10 serve to press and hold the contacting blank material firmly against the adjacent anvil cylinder 50. Simultaneous with this holding action of the stripper 10, the cutting blade 44 engages and penetrates the blank material CB, effectively severing the leading edge of the blank and producing a segment of leading trim scrap 62, as shown in FIG. 4C. It should be appreciated that under normal operating conditions the cutting blade 44 will not only penetrate the blank material, but will also extend into and penetrate the urethane coating 52 that is disposed on the surface of the anvil cylinder 50.

Figure 4D:
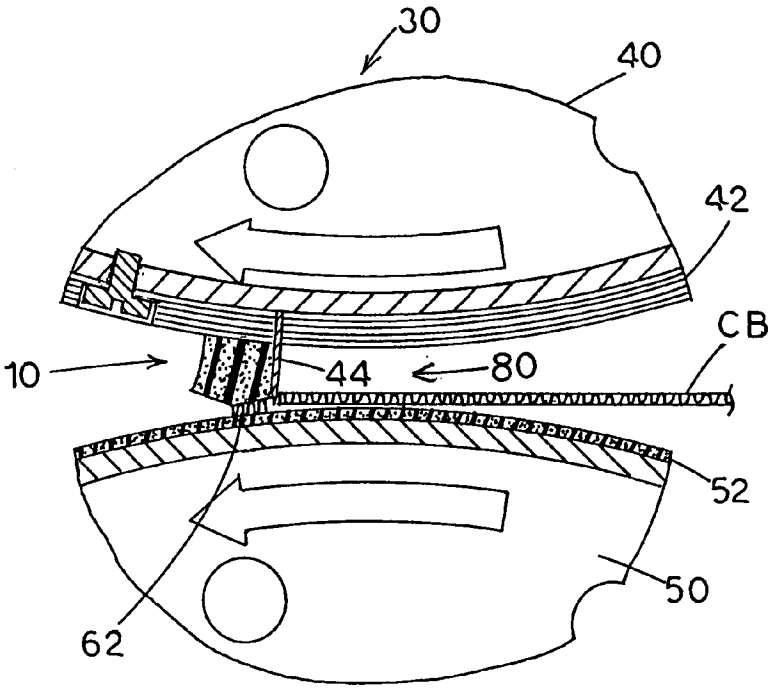
Figure 4C:
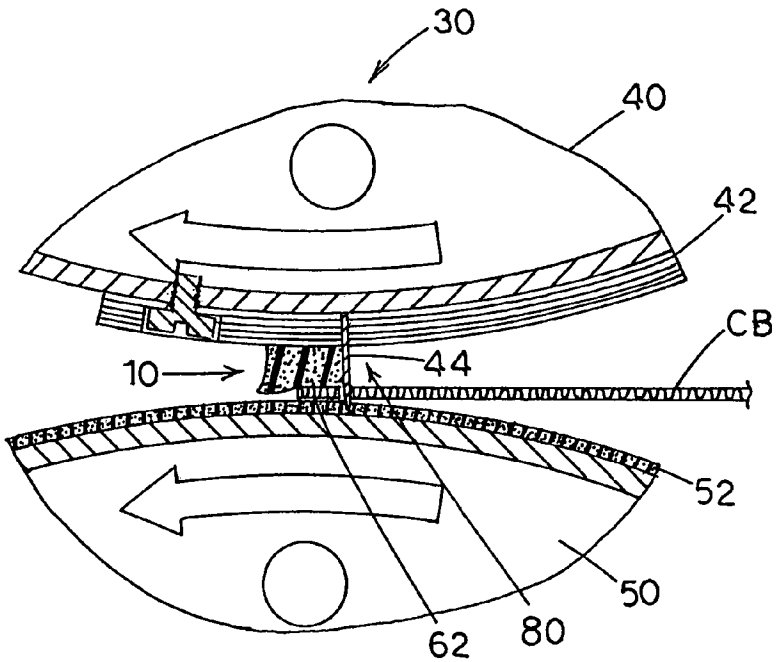
Figure 4F:
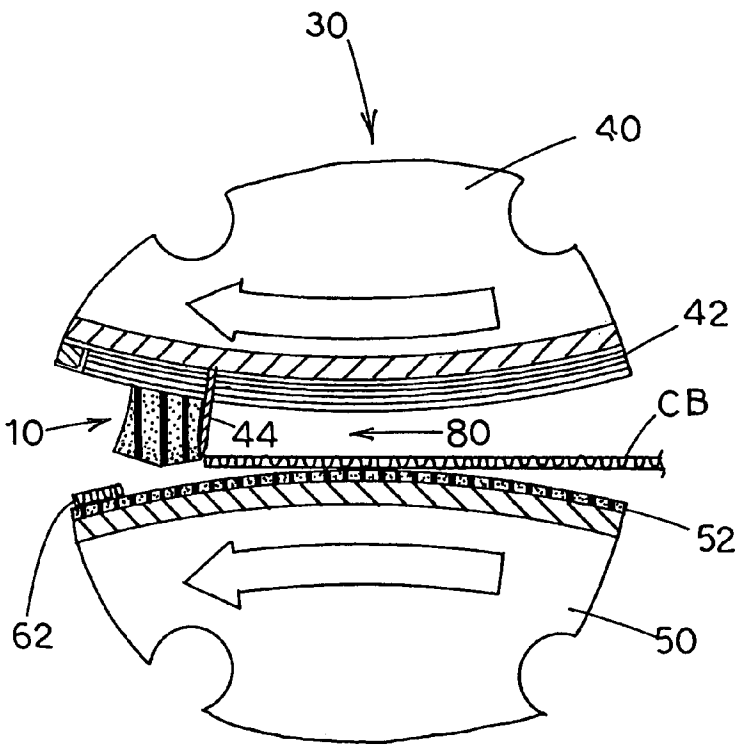
Figure 4E:
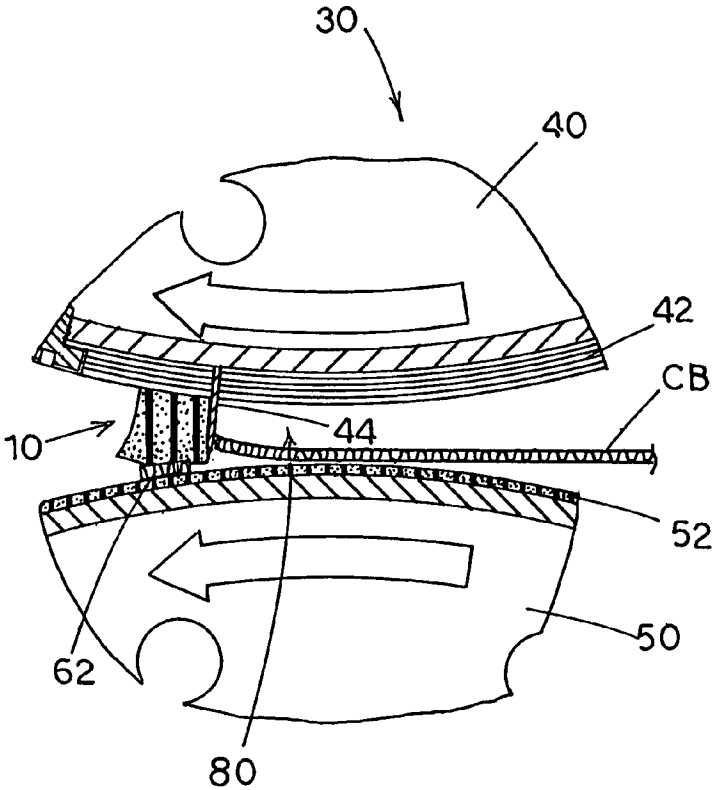

As the blank CB and newly formed trim scrap piece 62 proceed through and past the nip, it will be appreciated from FIG. 4D, that the blade 44 and integrally mounted stripper 10 tend to move generally away from the adjacent blank and scrap as a consequence of the cylindrical nature of the cylinders 40 and 50. AS this separation of scrap 62 and stripper 10 proceeds, the elastically deformed stripper 10 begins to recoil, and in the process tends to return to its original, generally pentagonal shape. During this recoiling process, the angled surface 12 of the stripper remains in general contact with the severed trim scrap 62, and continues to hold the scrap material firmly against the receding anvil surface. By doing such, the stripper 10 effectively forces the severed scrap material 62 to be expelled from the die 30 along a tangent to the anvil cylinder 50 that is angled or directed significantly lower than the path taken by the trimmed blank material or product. That is, the trimmed blank product shown in FIGS. 4E and 4F will tend to exit the die cutter 30 along a straight path that is approximately horizontal, as it is not intentionally held against the surface of the downwardly rotating anvil cylinder 50 following the cut. The trim scrap 62, however, is effectively held against the downwardly rotating anvil 50 for a period of time following the cut, and hence acquires some amount of downward velocity from the anvil. As a consequence, the trim scrap 62 tends to be thrown generally downward and clear of both the die cutter 30 and the discharged corrugated board product.

Once again, it should be appreciated that the above descriptions and drawings (FIGS. 4A–4F) relate to leading edge type stripping operations. As such, the stripper 10 is shown positioned on the left side of the cutting blade 44 in FIGS. 4A–4F. However, the die cutter could just as easily be configured to perform trailing edge type stripping operations, in which case the stripper 10 would be positioned against the right side of a trail edge cutting blade, with respect to the apparatus shown in FIGS. 4A–4F. It should be noted however that, as per the previous definitions and discussions provided above, in the case of trailing edge trimming operations, the right side or face of the blade would be considered the scrap edge, ad the scrap region of the incoming blank would like to the right of the cutting blade. In any event, the stripper 10 would function in much the same manner as that described above for lead edge trimming operations. That is, the stripper serves to hold the cut scrap edge of the blank against the anvil cylinder and effectively directs the severed scrap generally downwardly and away from the discharged blank product.

Figure 5:
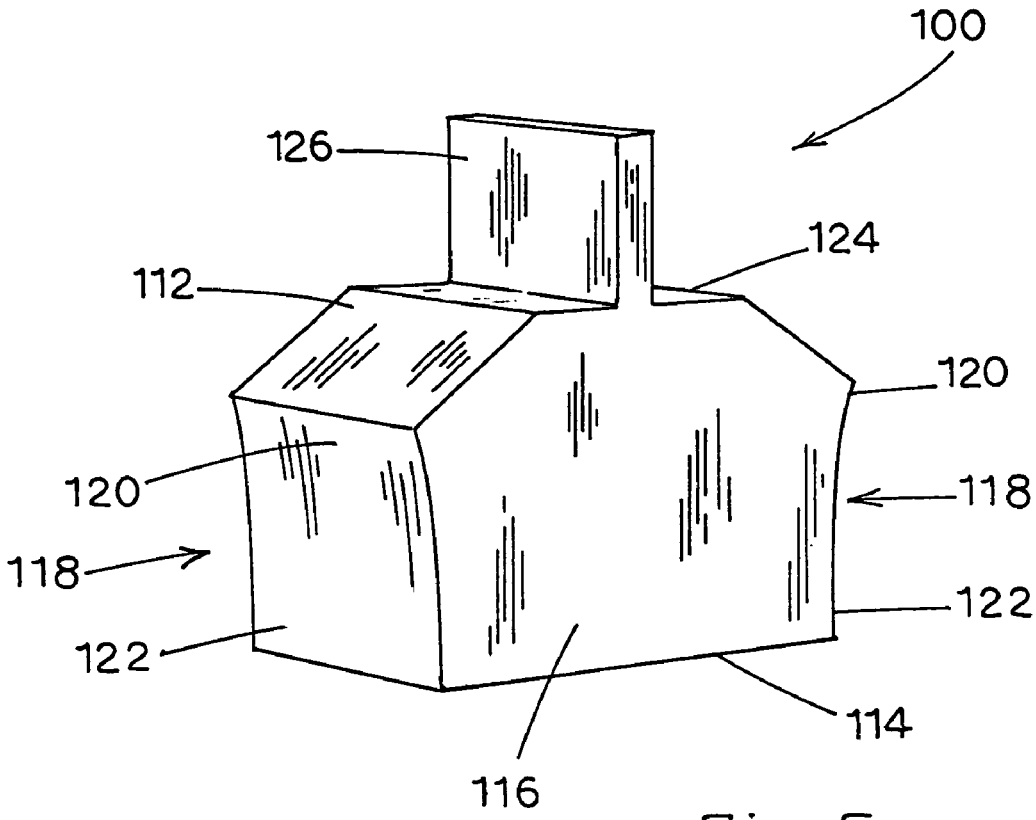
FIG. 5 is a perspective view of an alternative design for a trim stripper of the present invention.
Figure 6:
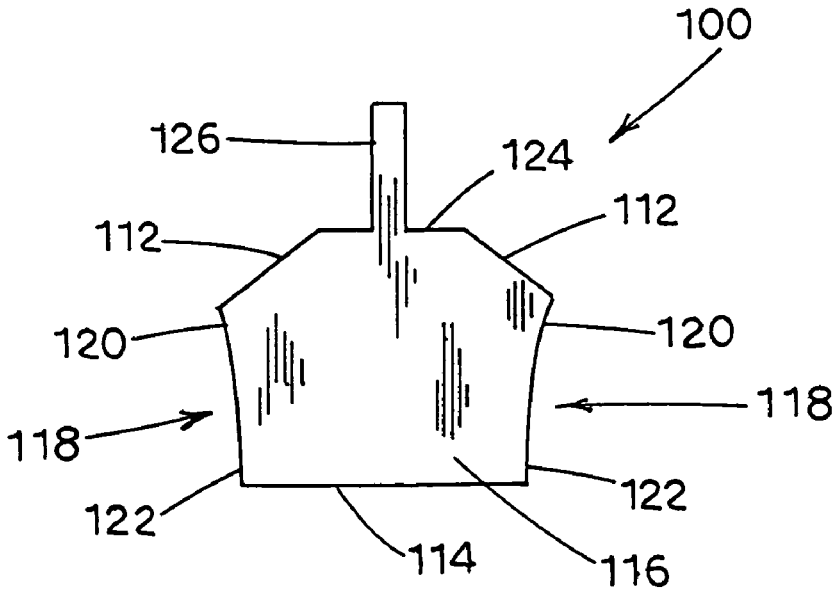
FIG. 6 is a side elevational view of a trim stripper shown in FIG. 5.

A trim stripper, representing a second embodiment and which is similar to the first embodiment described above, is shown in FIG. 5 and generally indicated by the numeral 100. Trim stripper 100 also includes a pair of angled stripper surfaces 112, a generally horizontal base 114, and a pair of generally vertical, sides 116. A pair of edge surfaces, generally indicated by the numeral 118, form the two remaining sides of the stripper 100. While the edge surfaces 118 are generally vertical in nature, the exact shape of these surfaces is in fact no linear, as illustrated in FIGS. 5 and 6. For purposes of illustration, each edge surface 118 may be considered to be comprised of a separate upper curved or bevel filler region 120 and a lower linear or flat region 122, in much the same manner as the first embodiment described above. Furthermore, stripper 100 includes a generally flat upper surface 124, extending outwardly from which is a flexible, finger-like projection or deflector 126.

As was the case with the first embodiment described, trim stripper 100 is typically manufactured from a resilient material such as 70 to 100 durometer closed cell rubber, although foam or other materials exhibiting appropriate resilient characteristics may also be utilized.

Once again, the second trim stripper embodiment described herein is substantially like the first embodiment discussed above and performs essentially the same function as the trim stripper 10 of the first embodiment. However, the second trim stripper embodiment performs the additional function of deflecting the severed scrap material as it flies off of and generally away from the die cutting assembly. As such, the discussion of the second trim stripper embodiment presented below will be generally focused on a discussion of the strippers deflection capability.

Figure 8:
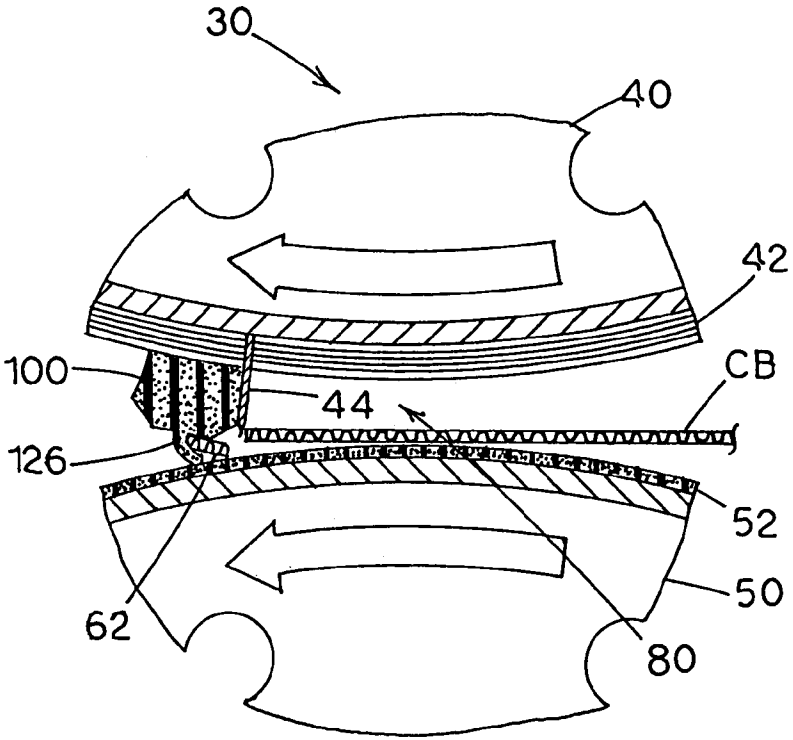
FIGS. 7–9 are a sequence of views showing the trim stripper of FIG. 5 and a corrugated board moving through the nip of a rotary die cutting assembly.
Figure 7:
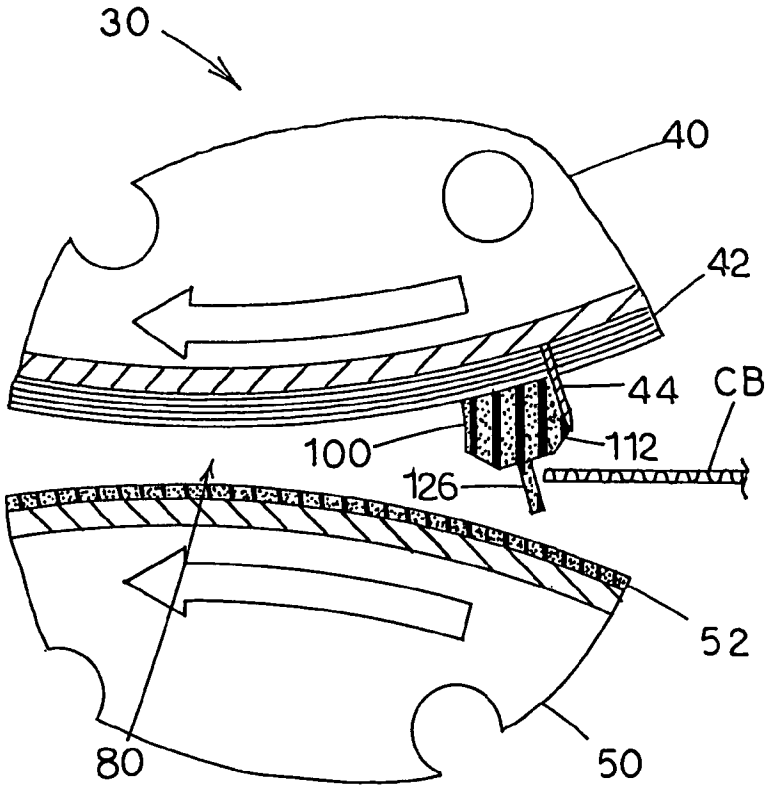
Figure 9:
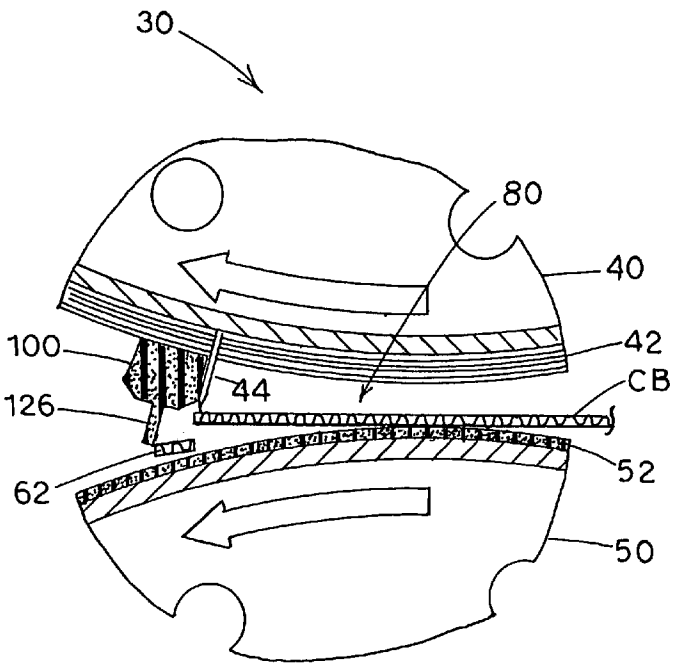
Figure 10:
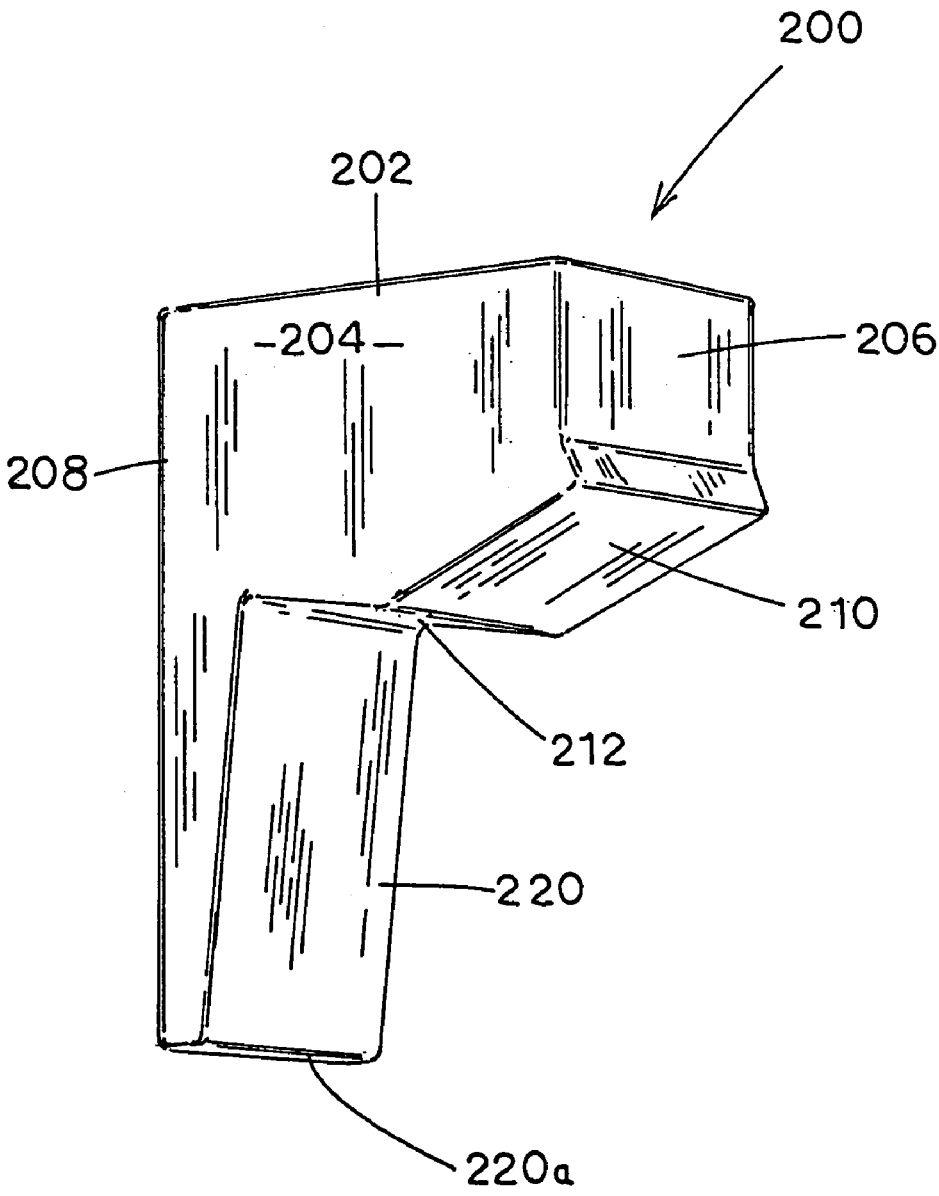
FIG. 10 is a perspective view of a third embodiment of the trim stripper of the present invention.
Figure 12:
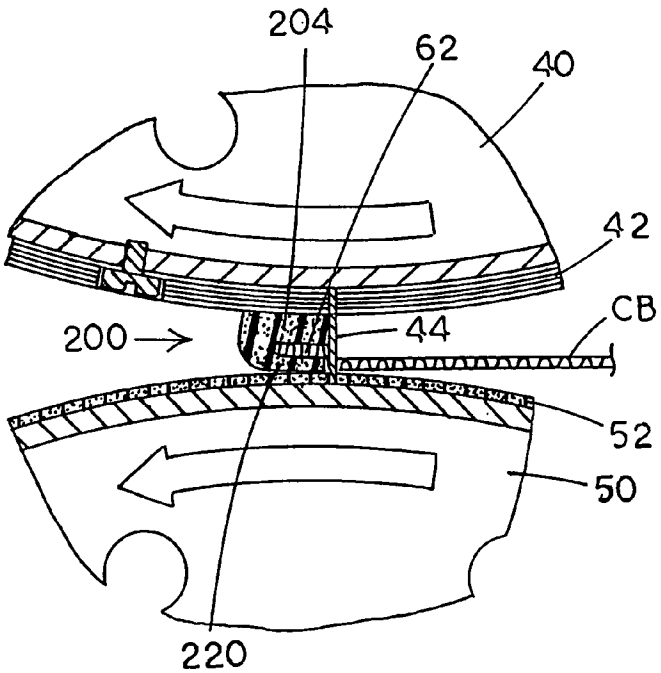
FIGS. 11–14 are a sequence of fragmentary sectional views illustrating the movement of the trim stripper of the third embodiment and a sheet of corrugated board through the nip defined between the cutting die and the anvil cylinder of a rotary die cutting apparatus.
Figure 11:
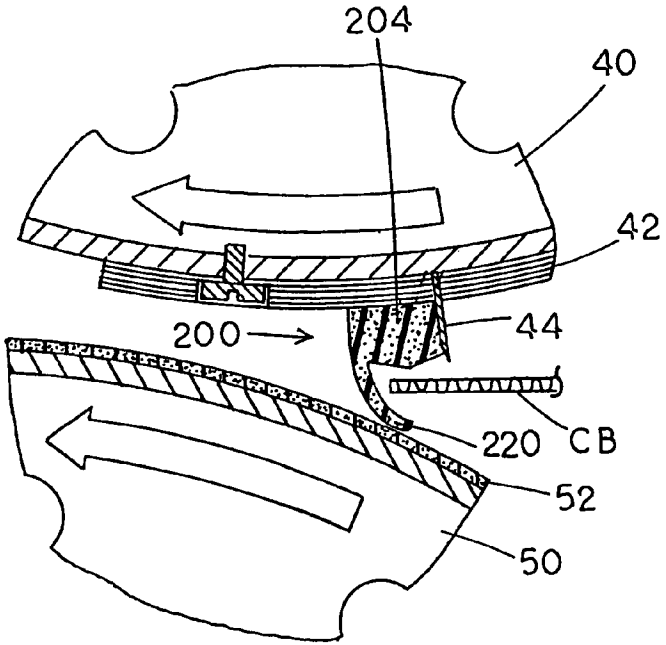

Illustrated in FIGS. 7–9, is the nip region of the corrugated board rotary cutting die apparatus 30. Trim stripper 100 is positioned on the die board 42 immediately adjacent the cutting blade 44, in a manner that is substantially the same as that described for the stripper 10 of the first embodiment. As shown in FIG. 7, trimming and stripping of the blank CB begins with the insertion or entry of the corrugated board blank into the die cutter 30. Insertion of the blank CB into the die cutter is synchronized with the position of the trimming or cutting blade 44, such that the edge of the blank that is to be trimmed enters the nip at approximately the same time as the cutting blade. The cutting blade 44 and incoming blank CB will tend to move together into and through the nip with the edge region of the blank that is to trimmed just leading the adjacent blade. As shown in FIG. 7, proper synchronization of the blank CB and cutting blade 44 also insures that the flexible deflector finger 126 leads the forward edge of the blank as it approaches the nip 80. As the stripper 100 approaches and passes through the nip, the angled surface 112 generally engages the blank and is elastically deformed in manner analogous to that described above for the first stripper embodiment. Furthermore, in the case of stripper 100, the flexible deflector finger 126 is deformed such that the tip of the finger is folded back generally towards the cutting blade 44, as illustrated in FIG. 8. After the stripper 100 passes through the nip 80, the elastically deformed deflector finger springs back to it's original, generally extended conformation. As such, the extended finger 126 effectively blocks or deflects the flight of the severed scrap 62, following release of the scrap by the angled surface 112 (FIG. 9). In so doing, the deflector 126 urges the ejected scrap 62 into a lower exit trajectory than might otherwise be accomplished.

In any event, the striper 100 described in the second embodiment functions in much the same manner as that described above for the first stripper embodiment, with the added benefit of an integral deflector finger 126 which serves to further lower the exit trajectory of the severed scrap material and generally enhance the scrap-product separating performance of the overall rotary die cutting apparatus. That is, the angled surface 112 of the stripper serves to hold the scrap edge of the blank against the anvil cylinder 50 and effectively directs the severed scrap generally downwardly and away from the discharged blank product, while the finger 126 provides for additional downward deflection of the ejected scrap material once this scrap, is released by the angled surface 112.

In FIGS. 10–14, there is shown a third embodiment for the trim stripper of the present invention. The third embodiment is generally similar to the second embodiment discussed above and indicated generally by the numeral 200 in the drawings. Viewing the trim stripper 200 in more detail, it is seen that the same includes a main body portion and a flexible finger or deflector portion. First viewing the main body portion of the trim stripper 200, it is seen that the same includes a base or upper surface 202 that is designed to be secured by glue or other suitable means to the die board 42 that forms a part of the rotary cutting die. In addition the main body portion includes a pair of opposed sides 204, a trailing edge 206, and a leading edge 208. It will be appreciated, that the trailing edge 206 is designed to be disposed adjacent the trim cutting blade 44. In the embodiment shown in FIG. 10, the trailing edge 206 is similar to the trailing edge of the trim strippers of the first and second embodiments discussed above. However, it should be noted that the particular shape of the trailing edge 206 can vary from one design to another design. In particular, it may be beneficial to effectively space the majority portion of the trailing edge 206 slightly from the trim cutting blade 44. This can be accomplished by cutting out a lower portion of the trailing edge 206. In this case, that portion of the trailing edge 206 disposed adjacent the base 202 would fit flush against the trim blade 44. Because of the cutout just discussed, there would be a small space on the order of 0.01 inch, for example, between the lower portion of the trailing edge 206 and the trim blade 44.

Continuing to refer to the main body of the trim stripper 200, it is seen that the same includes a pair of angled surfaces 210 and 212. The angled surface 210 would serve essentially the same purpose and function as the angled surfaces of the other embodiments discussed herein.

Now turning to FIGS. 11–14, there is shown therein a sequence of drawings that illustrates the operation of the trim stripper 200 as it passes through the nip defined between the cutting die 40 and the anvil 50. Note in FIG. 11 where the flexible finger or deflector 220 begin to deflect back around the leading edge of the corrugated board CB as the corrugated board is fed between the cutting die 40 and the anvil 50. As the trim stripper 200 advances through the nip defined between the cutting die and the anvil, it is seen that the flexible finger or deflector 220 curls back around a leading edge portion of the corrugated board CB. In particular, note in FIG. 12 where the leading edge portion of the corrugated board CB has actually been cut by the blade 44, forming a scrap piece 62. Scrap piece 62 is partially surrounded or encompassed by the flexible finger 220 and the main body portion of the trim stripper 200. Again, this is particularly shown in FIG. 12. Moving to FIG. 13 it is seen that the trim stripper 200 has advanced clockwise to a point where it and the cut trim strip 62 has started to move from the nip defined between the cutting die 40 and the anvil 50. Even in this position, the cut trim 62 is still generally surrounded or retained by the flexible finger 220 and the main body portion of the trim stripper 200. Thus the trim stripper 200 is acting to exert control over the cut trim piece 62.

Figure 14:
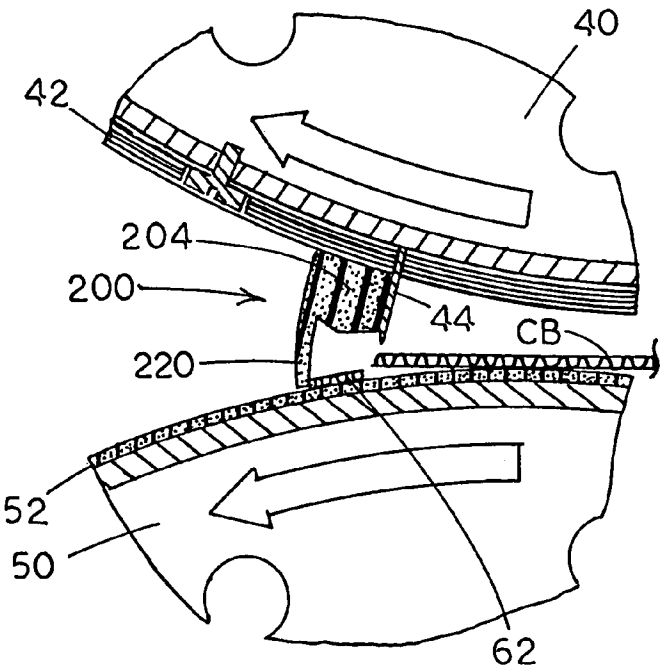
Figure 13:
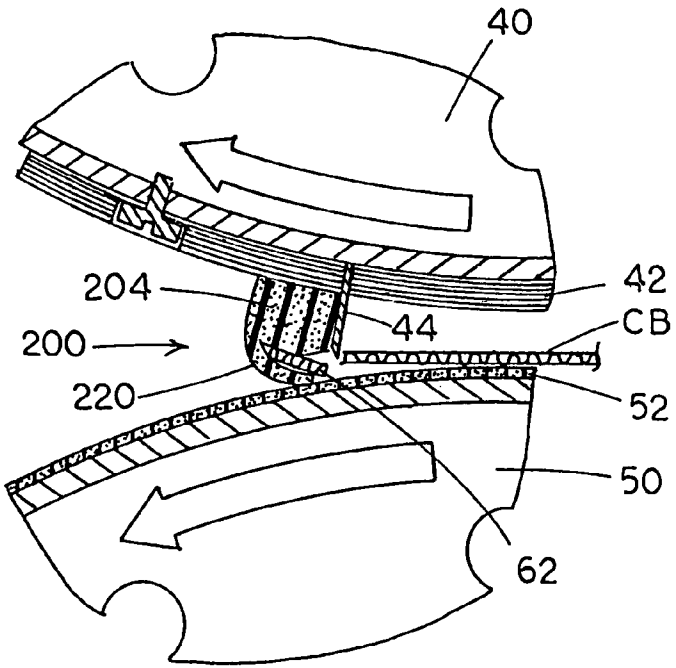
Figure 15:
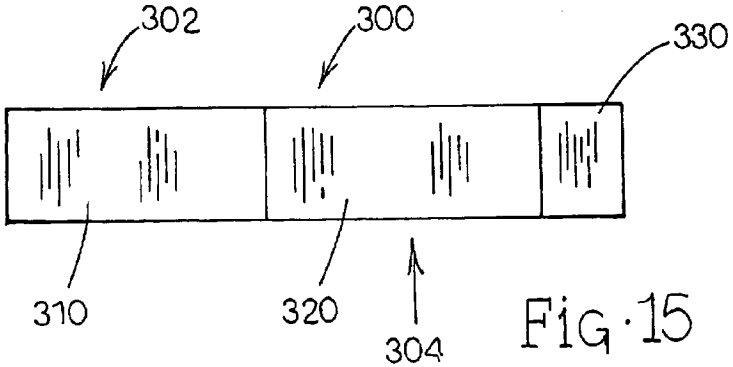
FIG. 15 is a top plan view of a fourth embodiment for a trim stripper or device for moving trim cut from a corrugated board.
Figure 18:
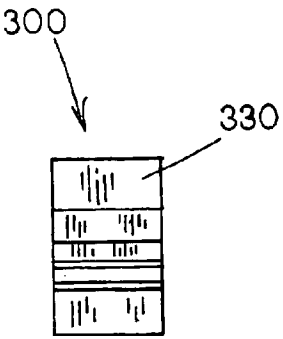
FIG. 18 is an elevational view of the front end of the device shown in FIG. 15.

Viewing FIG. 14, the trim stripper 200 has advanced slightly clockwise from the position depicted in FIG. 13. Now the flexible finger or deflector 220 has extended and the cut scrap piece 62 has been released to where it lies atop the anvil. However, the deflector or flexible finger 220 still acts to deflect or control the exiting movement of the cut trim 62. Note in FIG. 14 that the flexible finger or deflector 220 has the effect of preventing the cut trim piece 62 from flying or moving past the deflector 220. More particularly, the action of the trim stripper and particularly the flexible finger or deflector 220 generally acts to encourage the cut trim piece 62 to lie against the anvil and to move therewith as the cut trim piece 62 exits the nip. This generally insures that the path of the cut trim 62 will follow the anvil and accordingly will be directed generally downwardly as it exits the discharge side of the cutting die and anvil.

Finally, it should be appreciated that the trim strippers disclosed herein can be placed at various locations on the cutting die for stripping trim from any portion of the corrugated board. Thus the trim strippers disclosed herein can be used to control the discharge of leading and trail edge of trim as well as side trim.

Figure 17:
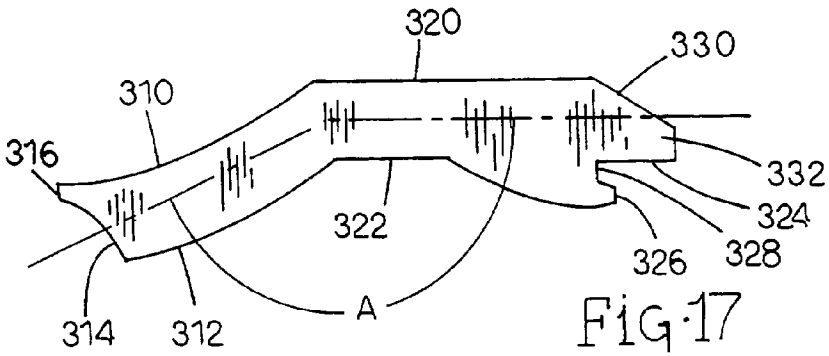
FIG. 17 is a side elevational view of the device shown in FIG. 15.
Figure 19:
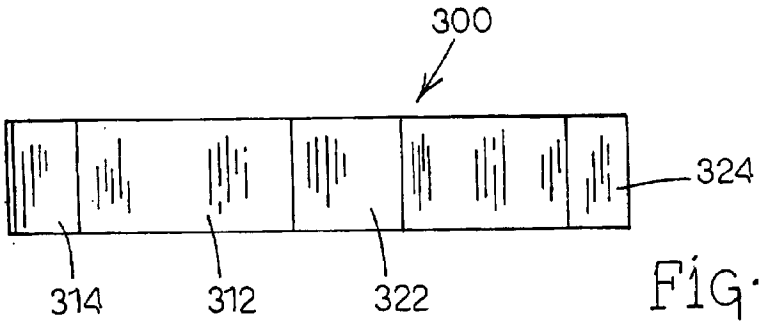
FIG. 19 is a bottom plan view of the device shown in FIG. 15.
Figure 16:
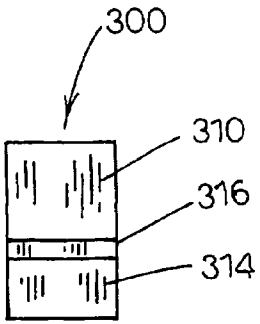
FIG. 16 is an elevational view of a rear end of the device shown in FIG. 15.

Turning now to FIGS. 15–25, a fourth embodiment of a trim stripper or device for moving trim is shown. The trim stripper or device of the fourth embodiment is indicated generally by the numeral 300 and shown in FIGS. 15–19. Trim stripper 300 is constructed of an elastomer or rubber material. That is, the stripper 300 is flexible and compressible and includes a memory such that if a portion of the trim stripper 300 is deflected or moved, that portion, upon release, will return to its original position or configuration, as shown in FIG. 17, for example. Stripper 300 is sometimes referred to generally as being constructed of a rubber material. This simply means that the device can be constructed of genuine rubber or a synthetic material that has properties similar to rubber. Therefore, any number of synthetic elastic materials of various chemical compositions can be utilized to construct the trim stripper 300. In one particular embodiment of the present invention, the trim stripper 300 comprises a microcellular polyurethane elastomer. Such a material is manufactured under the trade name CELLASTO by Elastogran Kunststoff-Technik GmbH, a subsidiary of Elastogran GmbH, a member of the BASF Group. Typically, the density of this elastomer material ranges from 350 kg/m$^3$ to 650 kg/m$^3$. It will be understood and appreciated by those ordinarily skilled in the art, that various elastomer materials, of varying hardness, can be utilized for the trim stripper 300.

Viewing trim stripper 300 in more detail, it is seen that the same includes a base indicated generally by the numeral 302 and a finger, indicated generally by the numeral 304, extending from the base. The base is designed to be secured to a cutting die, such as a rotary cutting die. Accordingly, base 302 includes a securing surface 310. In the case of the design illustrated herein, the base 302 is adapted or designed to be secured to a rotary cutting die. Accordingly, the securing surface 310 is generally arcuate-shaped to generally conform with the shape of a rotary cutting die. However, the curvature of the securing surface 310 may be slightly less than the curvature of the cutting die such that when the securing surface 310 is first placed on the cutting die, during the securing operation, there may be a slight space between the securing surface 310 and the underlying cutting die. In any event, the securing surface 310 is secured to the cutting die by the use of a glue or adhesive. Once the glue or adhesive has been applied, the base 302 is pushed down so that the securing surface 310 conforms to the underlying cutting die and in this process the entire base 302 is secured to the cutting die.

In addition, base 302 includes an outer surface 312 and an end 314. End 314, as seen in FIG. 17 for example, is generally curved or arcuate-shaped and there is provided a tip 316 that is formed adjacent one end of the securing surface 310.

Finger 304, extending from the base 302, includes a back edge 320 and an outer edge 322. Further, finger 304 includes a terminal end portion opposite the base 302. As will be appreciated from subsequent portions of this disclosure, the terminal end portion is designed to engage outside trim cut from a corrugated board passing through a cutting die apparatus. More particularly, the terminal end portion of the finger 304 acts to engage an edge portion of the corrugated board and after an outside trim piece has been cut from the corrugated board, the finger 304 effectively moves the cut trim piece from the trim cutting blade and away from the cutting die, and in the process separates the cut trim piece from the corrugated board product.

Viewing the terminal end portion of the finger 304, it is seen that the same includes a nose 332 and an engaging surface or lip 324. Specifically, in the embodiment illustrated herein, the engaging surface 324 engages a piece of outside trim that is cut by the die cutting apparatus. In addition to engaging surface 324, about the outer terminal end portion of the finger 304, there is provided another surface 326 and a back edge 328. In the case of the embodiment illustrated in FIGS. 15–25, the surfaces 324, 326 and 328 form a slot or mouth. As will be appreciated from subsequent portions of the disclosure, in some embodiments and in some processes, an edge of an oncoming corrugated board that is being directed through the die cutting apparatus is directed into the mouth formed about the terminal end portion of the finger 304.

It will be understood, however, that a mouth or slot such as shown in the embodiment of FIG. 17 is not essential. That is, the outer terminal end portion of the finger may simply engage the cut trim piece and after engagement, direct the cut trim piece from the trim blade and cutting die.

Continuing to refer to the terminal end portion of finger 304, it is seen that as viewed in FIG. 17, there is provided an angled edge 330 about the upper portion of the finger 304. As will be fully appreciated from a review of FIGS. 21–25, this angled edge 330 results in an open space or void being formed between the angled edge 330, the trim blade 44, and the cutting die 31 when the finger 304 is deflected to the position shown in FIG. 22. During the course of a die cutting operation, the finger 304 is deflected back repeatedly as the die cutting apparatus 30 rotates and cuts corrugated board. By providing the angled edge 330, the mass of the finger 304 is reduced, especially in the area adjacent the trim blade 44. This reduction in mass tends to decrease the likelihood that the trim blade 44 will be damages by repeated impacts with the terminal end of the finger 304.

Figure 20:
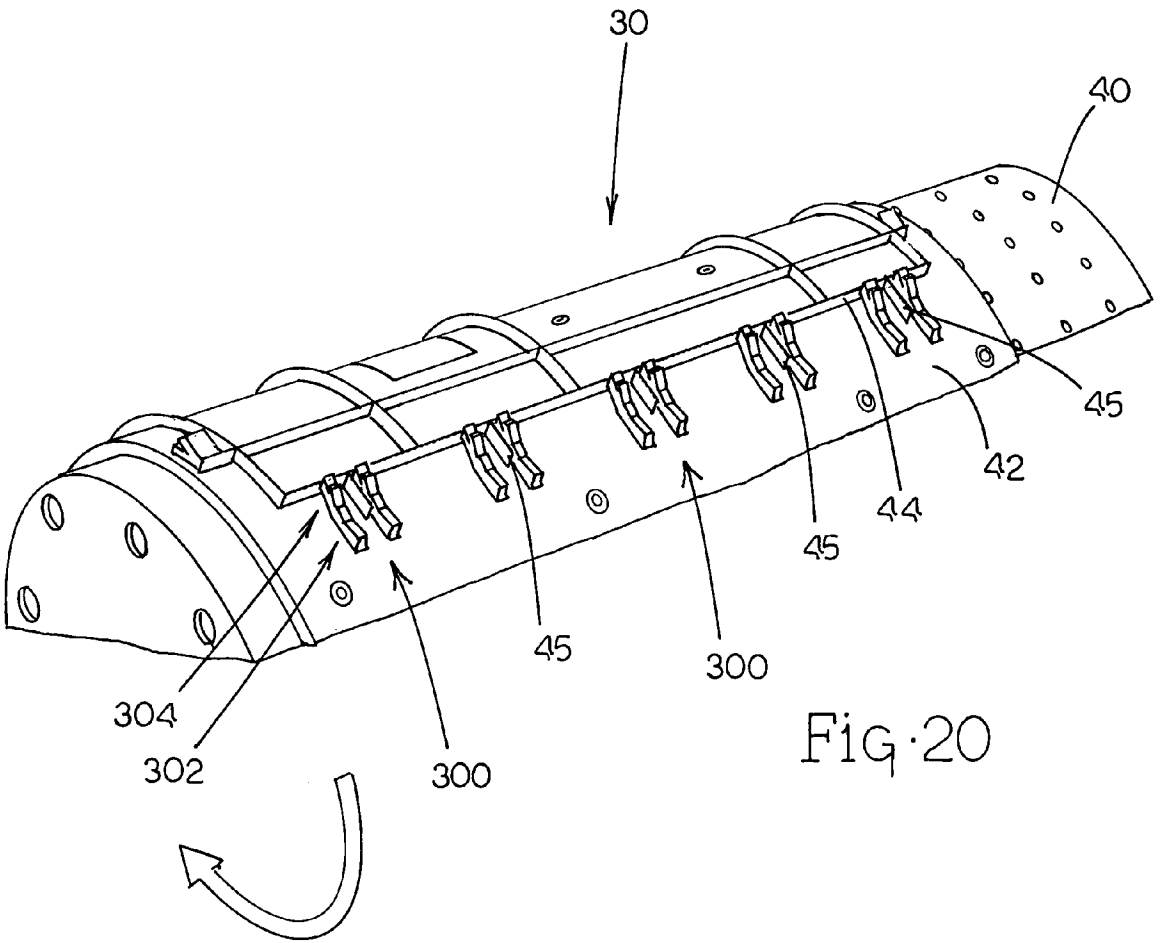
FIG. 20 is a fragmentary perspective view of a rotary cutting die having the device shown in FIG. 17 mounted thereon.

Turning now to FIG. 20, there is shown a fragmentary perspective view of a cutting die apparatus that is indicated generally by the numeral 30. Cutting die apparatus includes a die cylinder 40 and an anvil or urethane cylinder 50. A cutting die, indicated generally by the numeral 31, is mounted to the die cylinder 40. Details of the cutting die 31 will not be dealt with herein in detail because such is well known in the art. For example, it is typical for such cutting dies to include a die board or base 42 which includes a variety of cutting blades or rules, scoring rules, scrap ejectors, etc. Also, it is typical that cutting dies include outside trim blades. Typically, a cutting die will include one or more leading edge trim blades, one or more trailing edge trim blades, and a series of side edge trim blades. In the case of the die cutting apparatus 30 shown in FIG. 20, there is provided a leading edge trim blade indicated by the numeral 44. Periodically spaced on the outside of the trim blade 44 is a series of trim breakers 45. Note that the trim breakers extend forwardly from the trim blade 44 and are disposed at an angle generally perpendicular to the trim blade 44.

The trim strippers or devices 300 of the fourth embodiment are disposed forwardly or on the outside of the trim blade 44. That is, the trim strippers or devices 300 lead the trim blade 44 as the die cylinder 40 rotates. In the case of the embodiment illustrated in FIG. 20, a trim stripper or device 300 is disposed adjacent each side of the trim breakers 45. The spacing of the trim strippers or devices 300 can vary. Typically, they are disposed in pairs on opposite sides of the trim breakers 45 and each pair of trim strippers or devices 300 can be spaced approximately 3–6 inches on center. As seen in FIG. 20, the base 302 of each trim stripper 300 is secured to the cutting die 31 such that there is a space between the base 302 and the adjacent trim blade 44. The finger 304 extending from each base extends at an angle from the base and towards the trim blade 44. However, the finger 304 angles outwardly from the cutting die 31 such that when the trim stripper 300 assumes a normal orientation, where the finger 304 is not deflected, there is an open space between the finger 304 and the adjacent cutting die 31. In securing the trim stripper to the cutting die 31, care is taken to properly space the base 302 from the trim blade 44. In particular, the base 302 is glued to the cutting die at a point that results in the finger 304 barely touching the outside of the trim blade 44, or being closely spaced thereto, when the finger is deflected to a position adjacent the cutting die 31. That is, the base 302 is secured in a position where the terminal end of the finger 304 just barely touches or is slightly spaced from the trim blade 44 when the finger is deflected against the cutting die 31.

FIGS. 21–25 depict a sequence of view that illustrate how the trim stripper or device 300 functions to engage cut outside trim pieces and direct these trim pieces away from the cutting die 31. For simplicity and ease of illustration, the trim breakers 45 are not shown in FIGS. 21–25.

Figure 21:
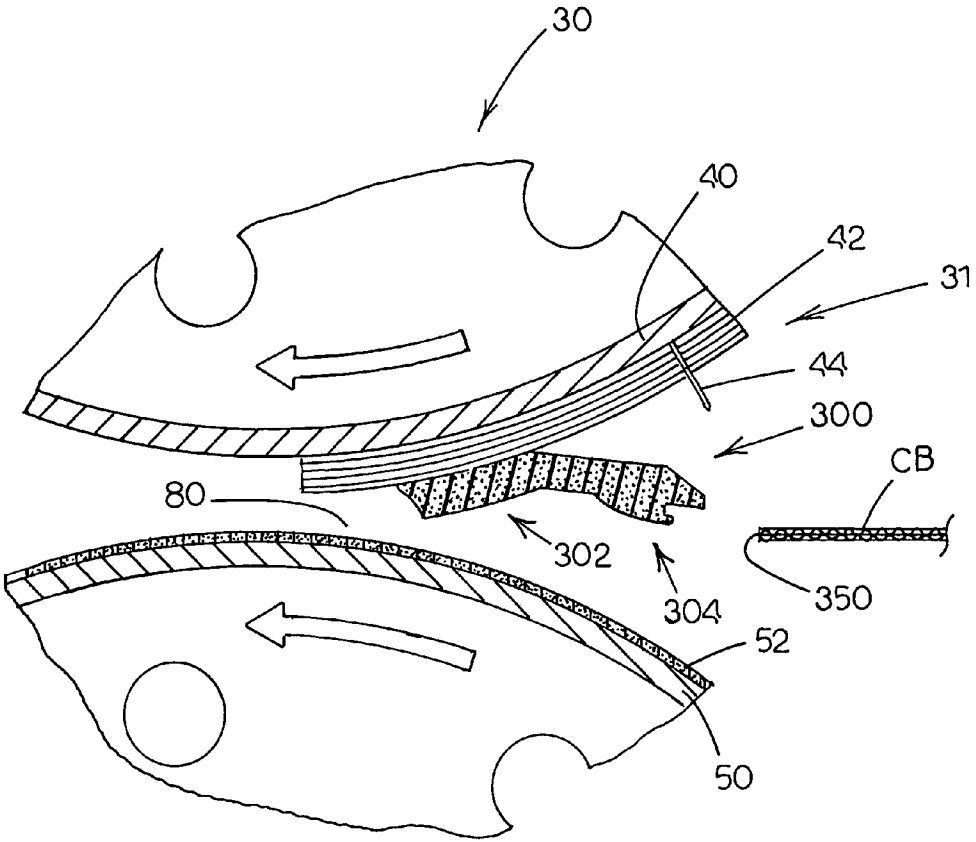
FIGS. 21–25 are a sequence of fragmentary sectional views illustrating the movement of the device shown in FIG. 17 through the nip defined between a rotary cutting die and a rotary anvil of a die cutting assembly.

FIG. 21 illustrates the trim stripper or device 300 mounted to the die board or base 42 of the cutting die 31. Note that the base 302 is firmly secured to the cutting die 31. Further, the finger 304 extends outwardly from the cutting die 31 and at an angle with respect to the base 302. The position of the trim stripper or device 300 as shown in FIG. 21 is referred to as the normal position of the device. That is, the position shown in FIG. 21 is the position that the finger 304 will normally assume in a free state or in a situation where the finger is not engaged and moved by another object such as the anvil cylinder 50. The position of the finger 304 as shown in FIG. 21 is also referred to as the first position. Also, in FIG. 21, it is seen that the die cylinder 40 is rotating clockwise while the anvil cylinder 50 is rotating counter-clockwise. As with the other embodiments discussed herein above, defined between the die cylinder 40 and the anvil cylinder 50 is nip 80. As illustrated in FIG. 21, a corrugated board CB has a leading edge 350 and is being advanced towards the nip 80.

Figure 22:
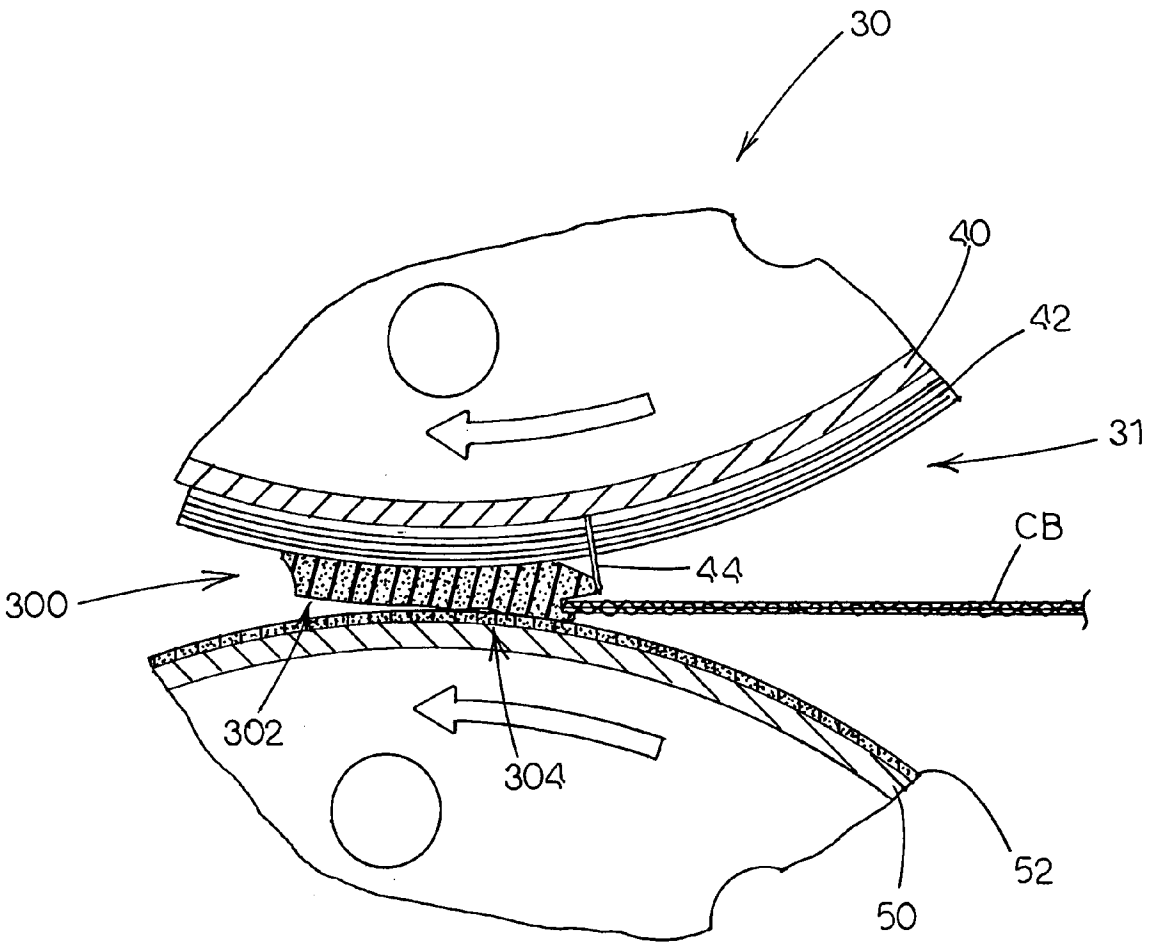

Turning to FIG. 22, both cylinders 40 and 50 have rotated from their positions shown in FIG. 21. In the process, the die cylinder 40 carrying the cutting die 31 has caused the trim stripper or device 300 to be passed into the nip 80. Because of the spacing between the cylinders 40 and 50, the anvil cylinder 50 effectively engages the finger 304 and deflects the finger away from its normal first position towards the cutting die 31. The position of the finger 304 as shown in FIG. 22 is referred to as a second position or trim engaging position. At this point in the die cutting process, the corrugated board CB has also been advanced. In the case of this embodiment and this particular illustration, the leading edge 350 of the corrugated board CB has been directed into the mouth of the finger 304. Thus, it is appreciated that in the case of this example, the corrugated board CB becomes engaged or touches the finger 304 prior to the trim blade 44 cutting an outside trim piece from the corrugated board. Also, in the position shown in FIG. 22, the outer end portion of the finger 304 has been compressed between the rotary cutting die 31 and the outer urethane surface 52 of the rotary anvil.

Figure 23:
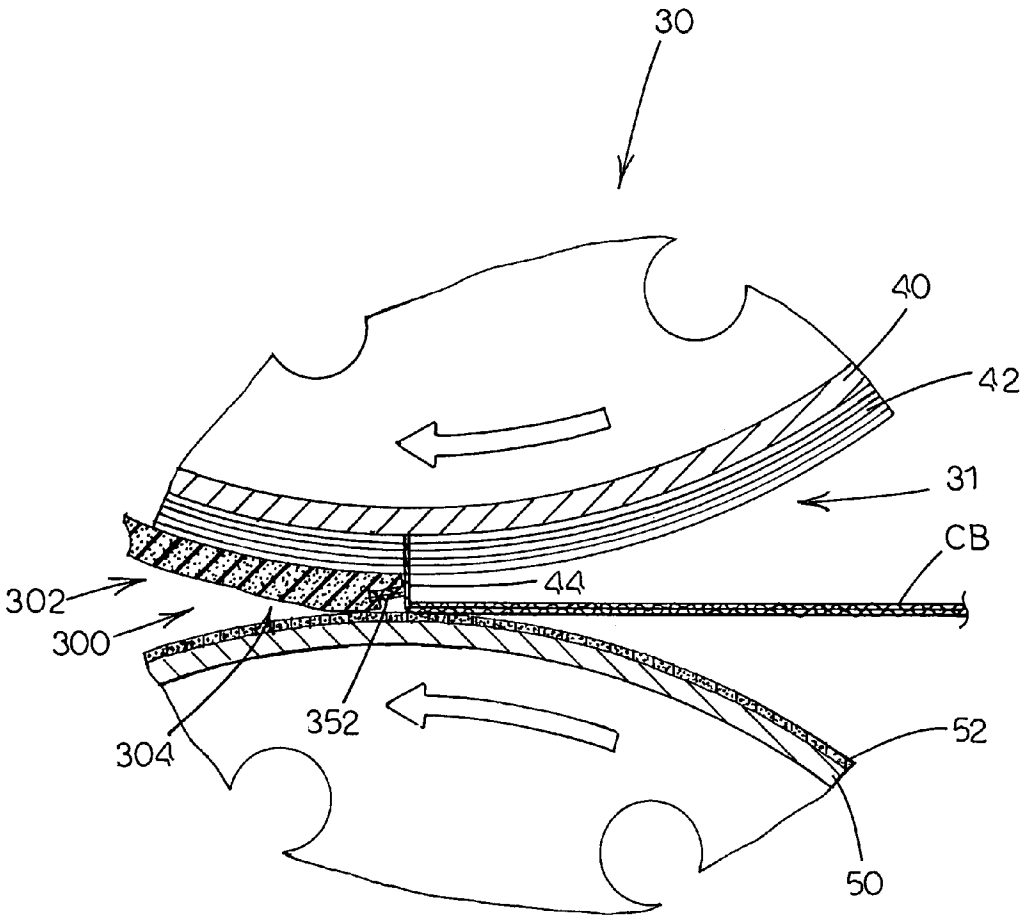

Viewing FIG. 23, cylinders 40 and 50 have advanced or rotated from the position shown in FIG. 22. They have advanced sufficient for the trim blade 44 to cut an outside piece from the corrugated board CB. This outside piece is referred to as a trim piece 352. It is seen in FIG. 23 that the outside trim piece 352 that has been cut is engaged by the end portion of the finger 304. While the cut trim piece 352 can be said to be held within the mouth of the finger 304, it is also important to appreciate that a particular mouth structure is not required. In the illustration of FIG. 23, it is seen that the engaging surface 324 is engaged with the cut trim piece 352.

Figure 24:
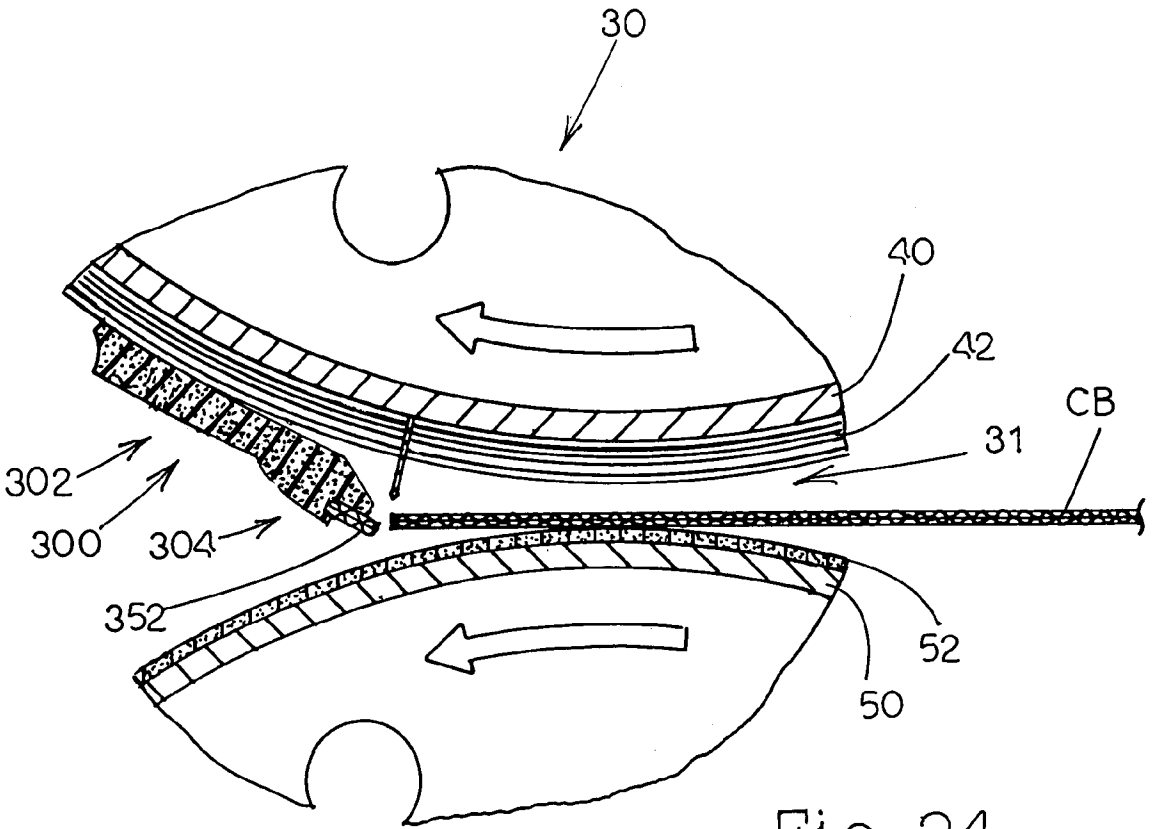

Viewing FIG. 24, the rotary cylinders 40 and 50 have advanced slightly from the position shown in FIG. 23. The trim stripper 300 and particularly FIG. 304 are beginning to exit or pass from the nip 80. As the finger 304 begins to exit the nip 80, the cutting die 31 and the outer surface of the anvil cylinder 50 begin to separate. As this happens, the finger 304 begins to move or spring back towards its normal first position. That is, the finger includes a memory and its natural tendency is to assume its normal first position, as shown in FIG. 21. Therefore, as the space or nip opens up, the finger 304 will automatically move away from the cutting die 31 and will carry or move the trim piece 352 in the process.

Figure 25:
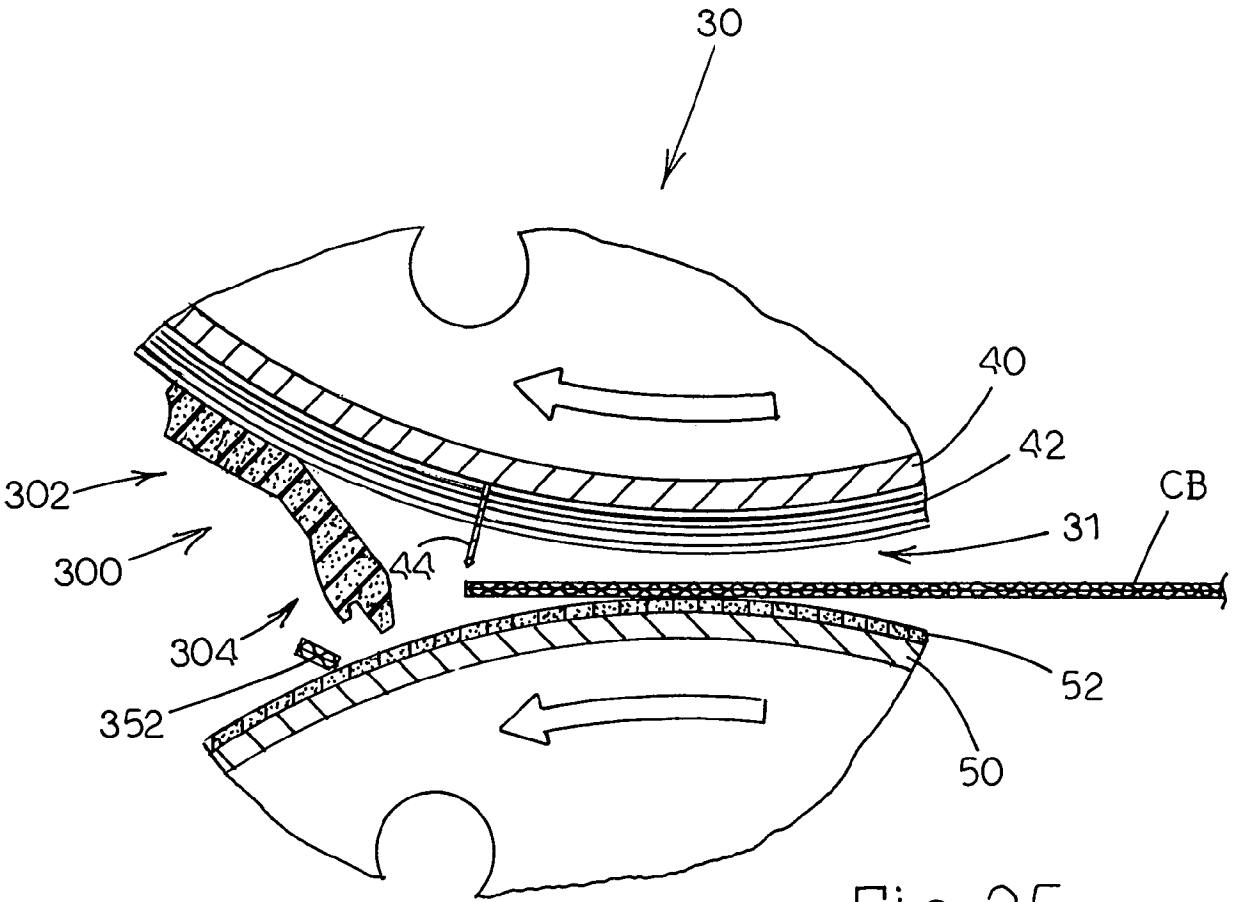

Finally, viewing FIG. 25, the cylinders 40 and 50 have slightly rotated from the positions shown in FIG. 24. In FIG. 25, the finger 304 has reached its normal first position. The trim piece 352 has effectively been discharged and moved downwardly towards the anvil cylinder 50. Effectively, the trim piece 352 has been moved by the finger 304 downwardly with respect to the corrugated board product that has been trimmed and otherwise cut and scored. This effectively separates the trim piece 352 from the corrugated board and assures that such scrap is not mixed with the actual corrugated product produced by the die cutting operation.

FIG. 17 by utilizing construction lines illustrates the general angle formed between the base 302 and the finger 304. While this angle, which is referred to as angle A in FIG. 17, can vary, in the case of the embodiment illustrated herein angle A is greater than 90°. In a preferred embodiment, angle A would range from approximately 135–160°. Again, however, this angle can vary depending upon the particular material being used for the trim stripper 300 and the particular application.

What is claimed is:

1. A rotary cutting die apparatus for cutting corrugated board and trimming an outside trim piece from the corrugated board, comprising:

a die cylinder;

a cutting die adapted to be mounted to the die cylinder;

the cutting die including at least one trim cutting blade for cutting an outside trim piece from a sheet of corrugated board being fed through the rotary cutting die apparatus;

at least one elastomer trim transfer device secured to the cutting die for engaging the trim piece and transferring the trim piece away from the trim cutting blade; and the elastomer trim transfer device including:

a base secured to the cutting die;

a finger extending from the base and normally assuming a first position where the finger extends at an angle from the base and away from the cutting die;

wherein the finger is moveable from the first position to a second position adjacent the cutting die; and wherein the finger includes a mouth for engaging the trim piece and transferring the trim piece away from the trim blade as the finger moves from the second position towards the first position.

2. The rotary cutting die apparatus of claim 1 wherein when the finger assumes the second position the mouth is generally aligned to receive an edge of the corrugated board being directed through the rotary cutting die.

3. The rotary cutting die apparatus of claim 1 wherein the mouth of the finger includes an open slot.

4. The rotary cutting die apparatus of claim 3 wherein the open slot includes an upper surface, a lower surface, and a back surface, and wherein one of the upper and lower surfaces has a greater depth than the other.

5. The rotary cutting die apparatus of claim 1 including an anvil cylinder disposed adjacent the die cylinder and wherein there is a nip defined between the two cylinders, and wherein the finger is deflected from the first position towards the second position in response to the trim transfer device passing through the nip.

6. The rotary cutting die apparatus of claim 5 wherein at least a portion of the finger is compressed as the finger passes through the nip.

7. The rotary cutting die apparatus of claim 6 wherein the trim transfer device is mounted on the cutting die such that the base leads the finger.

8. The rotary cutting die apparatus of claim 1 including an anvil cylinder disposed adjacent the die cylinder so as to define a nip between the two cylinders, and wherein in the first position the finger assumes a normal position with respect to the base and wherein as the finger passes through the nip, the finger is engaged by the anvil cylinder and deflected towards the second position where the mouth engages the trim piece, and wherein as the finger passes from the nip, the finger will spring back towards the first position and in the process direct the trim piece downwardly so as to separate the trim piece from the corrugated board.

9. The rotary cutting die apparatus of claim 8 wherein the finger is of a thickness such that as the finger passes through the nip at least a portion of the finger is compressed between the cutting die and the anvil cylinder.

10. A trim transfer device for being mounted adjacent a trim cutting blade secured on a die board of a rotary cutting die for engaging and transferring trim pieces cut from a corrugated board being directed through a nip area between the rotary cutting die and a rotary anvil, the trim transfer device comprising:

a base adapted to be secured to the rotary cutting die adjacent the trim cutting blade;

an elastomer trim deflecting finger extending from the base such that when the base is mounted to the rotary cutting die the finger assumes a first position where the finger projects outwardly from the rotary cutting die;

wherein the finger is deflectable from the first position towards the rotary cutting die and is operative to assume a second position where the finger lies in contact with the die board; and the finger including a trim engaging surface that includes a mouth for engaging trim pieces cut from the corrugated board by the rotary cutting die and for transferring the cut trim pieces away from the corrugated board and rotary cutting die in response to the finger moving from the second position towards the first position.

11. The trim transfer device of claim 10 wherein when the finger assumes the second position the mouth is generally aligned to receive an edge portion of an oncoming corrugated board.

12. The trim transfer device of claim 10 wherein the finger is deflected from the first position to the second position as the finger passes through the nip, and wherein as the finger exits the nip, the finger springs outwardly towards the first position and the trim engaging surface of the finger engages a top portion of the cut trim piece and deflects the cut trim piece away from the corrugated board and away from the rotary cutting die.

13. The trim transfer device of claim 10 wherein the elastomer finger is normally angled with respect to the base.

14. The trim transfer device of claim 10 wherein the base and finger form an integral elastomer structure wherein the base includes a securing surface, an outer surface, and an end, and wherein the finger extends at an angle from the base.

15. The trim transfer device of claim 10 wherein the device is adapted to be secured to the rotary cutting die in a position spaced from the trim cutting blade such that when the finger is deflected to the second position a terminal end portion of the finger lies adjacent the trim cutting blade.

16. The trim transfer device of claim 15 wherein a portion of the finger engages a cut trim piece when the finger assumes the second position, and wherein as the trim transfer device exits the nip, the finger is biased to assume the first position, and as the finger moves from the second position to the first position, a portion of the finger is operative to transfer the engaged cut piece of trim away from the rotary cutting die.

17. The device of claim 10 wherein the finger in the first position forms an angle greater than 90° with the base.

18. The device of claim 17 wherein the finger in the first position forms an angle greater than 135° with respect to the base.

19. The device of claim 10 wherein the base including a securing surface and wherein at least a portion of the securing surface is curved-shaped.

20. The device of claim 10 wherein the base includes an end that is at least partially curved-shaped.

21. The device of claim 10 wherein the base and finger are integrally constructed of a microcellular polyurethane elastomer.

22. The device of claim 10 wherein at least a portion of the finger is compressible.

23. The device of claim 10 wherein the trim engaging surface of the finger extends inwardly into the finger.

24. The device of claim 10 wherein the trim engaging surface of the finger engages a top portion of a cut piece of trim and wherein as the finger moves from the second position towards the first position, the trim engaging surface is operative to move the cut piece of trim away from the cutting die.

25. The rotary cutting die of claim 1 wherein the mouth includes a first surface that engages the trim piece and transfers the trim piece away from the trim blade as the finger moves from the second position towards the first position.

26. The rotary cutting die of claim 25 wherein the mouth further includes a second surface spaced from the first surface so as to define a space therebetween.

27. The rotary cutting die of claim 26 wherein the second surface has a depth less than the depth of the first surface.

28. The rotary cutting die of claim 26 wherein the first surface and the second surface define the mouth.

29. The trim transfer device of claim 10 wherein the mouth includes a first surface for engaging a trim piece cut by the rotary cutting die and transferring the cut trim piece away from the rotary cutting die in response to the finger moving from the second position towards the first position.

30. The trim transfer device of claim 29 wherein the mouth includes a second surface space from the first surface.

31. The trim transfer device of claim 30 wherein the second surface is spaced from the first surface so as to form an open area therebetween.

* * * * *